US006048169A

United States Patent [19]

Feldmüller et al.

[11] Patent Number: 6,048,169

[45] Date of Patent: Apr. 11, 2000

[54] TURBINE SHAFT AND METHOD FOR COOLING A TURBINE SHAFT

[75] Inventors: Andreas Feldmüller, Bochum; Helmut Pollak, Mülheim an der Ruhr, both of Germany

[73] Assignee: Siemens Aktiengesellschaft, Munich, Germany

[21] Appl. No.: 09/217,853

[22] Filed: Dec. 21, 1998

Related U.S. Application Data

[63] Continuation of application No. PCT/DE97/00953, May 12, 1997.

[30] Foreign Application Priority Data

Jun. 21, 1996 [DE] Germany ..... 196 24 805

[51] Int. Cl.[7] ..... F01D 5/14

[52] U.S. Cl. ..... 415/115; 415/103; 416/97 R; 416/96 R

[58] Field of Search ..... 415/115, 100, 415/102, 103; 416/95, 96 R, 97 R, 201 R

[56] References Cited

U.S. PATENT DOCUMENTS

| | | | |
|---|---|---|---|
| 2,657,901 | 11/1953 | McLeod . | |
| 3,817,654 | 6/1974 | Sohma | 415/103 |
| 4,453,889 | 6/1984 | Sakata et al. | 416/201 R |
| 4,571,153 | 2/1986 | Keller | 415/103 |
| 5,507,620 | 4/1996 | Primoschuitz et al. | 416/96 R |

FOREIGN PATENT DOCUMENTS

| | | |
|---|---|---|
| 0 088 944 B1 | 9/1983 | European Pat. Off. . |
| 0 318 026 A1 | 5/1989 | European Pat. Off. . |
| 0 468 782 A2 | 1/1992 | European Pat. Off. . |
| 1 551 210 | 1/1970 | Germany . |
| 32 09 506 A1 | 9/1983 | Germany . |
| 259 566 | 6/1949 | Switzerland . |

OTHER PUBLICATIONS

Patent Abstracts of Japan No. 06–330702 (Shinya et al.), dated Nov. 29, 1994.

*Primary Examiner*—Edward K. Look
*Assistant Examiner*—Richard Woo
*Attorney, Agent, or Firm*—Herbert L. Lerner; Laurence A. Greenberg; Werner H. Stemer

[57] ABSTRACT

A turbine shaft extends along a principal axis and has an outer surface. The turbine shaft is formed by a plurality of cylindrical shaft segments which are disposed axially one behind the other and are braced together by a bracing element. An axial gap which is formed between the bracing element and at least one shaft segment is connected in terms of flow to two axially spaced radial passages. The radial passages each open at the outer surface of the turbine shaft. A method for cooling a turbine shaft is also provided.

12 Claims, 1 Drawing Sheet

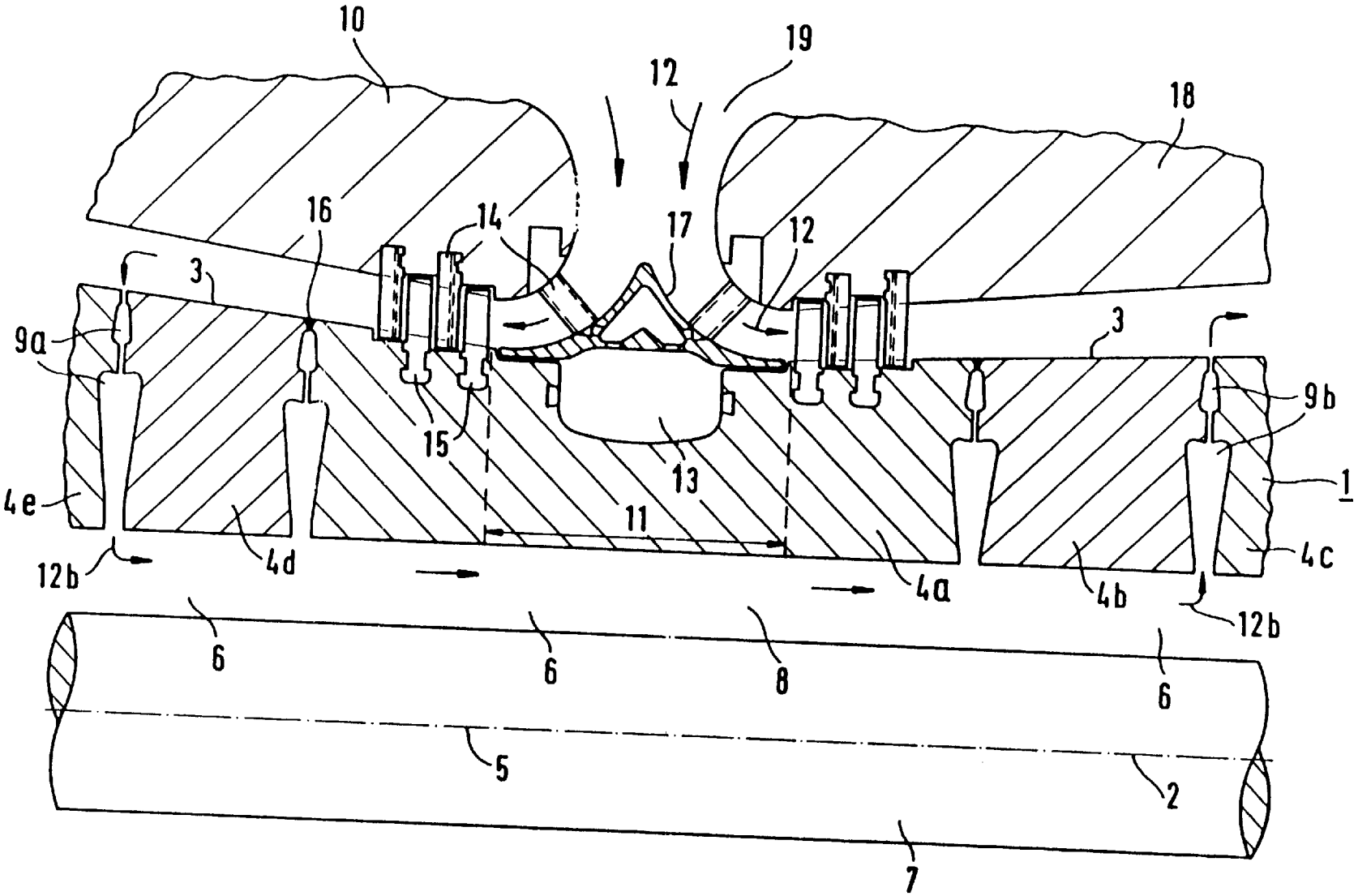
1
9b
4c
12b
18
3
4b
6
2
4a
7
19
12
8
12
17
13
11
6
14
5
15
10
16
4d
6
3
12b
9a
4e

TURBINE SHAFT AND METHOD FOR COOLING A TURBINE SHAFT

CROSS-REFERENCE TO RELATED APPLICATION

This application is a continuation of copending International application No. PCT/DE97/00953, filed on May 12, 1997, which designated the United States.

BACKGROUND OF THE INVENTION

Field of the Invention

The invention relates to a turbine shaft which extends along a principal axis and has an outer surface. The invention also relates to a method for cooling a turbine shaft.

The use of steam at relatively high pressures and temperatures, especially at so-called supercritical steam conditions, with a temperature of, for example, above 550° C. contributes to an increase in efficiency of a steam turbine. The use of steam with such a steam condition places increased demands on a steam-turbine shaft which is subjected to the steam.

German Published, Non-Prosecuted Patent Application DE 32 09 506 A1, to which European Patent 0 088 944 B1 corresponds, describes a shaft shield configuration with swirl cooling for a region of a turbine shaft which is directly subjected to live steam after it flows into the turbine. In swirl cooling, steam flows through four tangential holes in the shaft shield configuration into a region between the shaft shield configuration and the turbine shaft in the direction of rotation of the latter. In the process, the steam expands and the temperature falls, thereby cooling the turbine shaft. The shaft shield configuration is connected in a steam-tight manner to a row of fixed blades. Through the use of the swirl cooling, it is possible to achieve a temperature reduction of the turbine shaft in the vicinity of the rotor shield configuration of about 15 K. Nozzles are introduced into the shaft shield configuration for swirl cooling and, as seen in the direction of rotation of the turbine shaft, they open tangentially into an annular passage formed between the turbine shaft and the shaft shield configuration.

Swiss Patent No. 259 566 describes a rotor for a rotary machine, a rotor for gas turbines, which is transversely divided relative to a rotation axis, is composed of several parts and is held together by at least one central tie rod that penetrates at least a partial number of the rotor parts. The rotor is cooled, at least at its hottest points, through an air stream or gas stream.

German Published, Non-Prosecuted Patent Application DE-OS 15 51 210 describes a rotor for a high-powered steam turbine in a disc-type construction. The discs are connected to each other by a central tie rod. They have an asymmetrically shaped saw-toothing at rims which are tightened together.

SUMMARY OF THE INVENTION

It is accordingly an object of the invention to provide a turbine shaft which can be cooled in a region that can be subjected to high thermal loading and a method for cooling a turbine shaft disposed in a turbine, which overcome the hereinafore-mentioned disadvantages of the heretofore-known devices and methods of this general type.

With the foregoing and other objects in view there is provided, in accordance with the invention, a turbine shaft extended along a principal axis in a steam turbine, comprising an outer surface; a plurality of cylindrical shaft segments disposed axially one behind the other along the principal axis; the shaft segments each having a connecting opening along a common connecting axis for receiving a bracing element guided through the connecting openings and defining an axial gap between the bracing element and at least one of the shaft segments; and two axially spaced-apart radial passages or gaps connected to the axial gap in term of flow and each opening at the outer surface.

With such a turbine shaft, a flow connection is consequently formed between the outer surface of the turbine shaft and an axial gap situated in its interior. This allows cooling fluid to be introduced into the interior of the turbine shaft and guided out through the turbine shaft in the axial direction through the axial gap, thus ensuring cooling of the turbine shaft in the region of the axial gap. In the case of a steam turbine, the cooling fluid is preferably a working fluid (process steam), which imparts rotation to the turbine shaft by flowing against rotating blades connected to the turbine shaft. The radial passages preferably open at different pressure levels at the outer surface of the turbine shaft, so that a flow through the turbine shaft is set up automatically merely by the pressure drop. The volume flow of the cooling fluid which is diverted from the working fluid can be matched to the required cooling performance through the use of the geometrical configuration of the mouth of the radial passages at the outer surface. The working fluid (process steam) that is removed for cooling does not perform any mechanical work for driving the turbine shaft purely through the use of the differential-pressure level present between the radial passages. After flowing back out into the stream of working fluid through the radial passage at the lower pressure level, the working fluid used as cooling fluid again performs mechanical work too and thus contributes to the efficiency of the steam turbine.

In accordance with another feature of the invention, the cylindrical shaft segments, which are also referred to below as rotor discs, each have a central connecting opening through which a single bracing element (connecting element) or tie, is guided. The connecting opening has a larger cross-section than the tie, with the result that an annular axial gap is formed between the shaft segment and the tie to allow the cooling fluid to flow through.

In accordance with a further feature of the invention, there is provided a plurality of bracing elements (connecting elements) or ties, in particular three or more. The respective connecting axis of the connecting elements lies parallel to the principal axis of the turbine shaft. The respective connecting axes are preferably disposed on a circle, the center of which coincides with the principal axis.

In accordance with an added feature of the invention, at least one radial passage, especially both radial passages, are formed between two immediately adjoining shaft segments. This is achieved, for example, by providing corresponding depressions or recesses or grooves, in the adjoining shaft segments. However, a radial passage can also be formed by an essentially radial hole through the shaft segment from the outer surface to the connecting opening. In this context, "radial" preferably means perpendicular to the principal axis, but also includes any connection between the outer surface and the connecting opening which is aligned at least partially in the direction of the principal axis.

In accordance with an additional feature of the invention, the turbine shaft is provided for a double-flow turbine and, accordingly, has an axial central region which the working fluid reaches immediately after flowing into the turbine and in which it is divided into two essentially equal partial streams. The axial central region is preferably disposed axially between the radial passages.

In accordance with yet another feature of the invention, the central region, which is subjected to the working fluid at a maximum temperature, has a cavity through which cooling fluid can flow. The cavity preferably has a rotationally symmetrical structure with respect to the principal axis. It is closed off by a shielding element which has a rotationally symmetrical raised portion to divide the flow.

In accordance with yet a further feature of the invention, the cavity is connected to the axial gap in terms of flow. It is likewise possible to feed cooling fluid through the casing to a turbine and to a mounting that secures the shielding element to the casing.

The turbine shaft is preferably disposed in a steam turbine, especially a double-flow medium-pressure turbine-section. Cooling of the central region of the turbine shaft is ensured through the use of the flow path formed across the central region. The flow path includes the two axially spaced radial passages and the axial passage connected to them in terms of flow. In particular, working fluid acting as cooling fluid is guided out of the partial stream of one flow at a relatively low pressure level into the partial stream of the other flow. The working fluid used as cooling fluid is thereby fed back to the overall steam process and consequently contributes to the efficiency of the overall process.

With the objects of the invention in view there is also provided a method for cooling a turbine shaft of a steam turbine having a plurality of cylindrical shaft segments disposed axially one behind the other along a principal axis and braced together by a bracing element, which comprises introducing cooling steam into an axial gap between the bracing element and the shaft segment through a first radial passage and guiding the cooling steam out of the turbine shaft through a second radial passage.

As already explained above, it is thereby possible to cool a turbine shaft from the inside in a region subjected to high thermal loading during the operation of the turbine shaft. A turbine shaft of this kind is thus suitable even in a steam turbine installation with steam inlet temperatures of above 600° C.

In accordance with a concomitant mode of the invention, in order to perform appropriate cooling, the axial gap is supplied with a volume flow of cooling fluid of between 1% and 4%, in particular between 1.5% and 3%, of the total volume flow of live steam.

Other features which are considered as characteristic for the invention are set forth in the appended claims.

Although the invention is illustrated and described herein as embodied in a turbine shaft and a method for cooling a turbine shaft, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The figure of the drawing is a fragmentary, diagrammatic, longitudinal-sectional view of a turbine with a turbine shaft.

DESCRIPTION OF THE PREFERRED EMBODIMENTS

Referring now in detail to the single figure of the drawing, there is seen a portion of a longitudinal section through a double-flow medium-pressure turbine-section 10 of a steam turbine installation. A turbine shaft 1 is disposed in a casing 18. The turbine shaft 1 extends along a principal axis 2 and has a plurality of shaft segments 4*a*, 4*b*, 4*c*, 4*d*, 4*e* disposed axially one behind the other. Each shaft segment 4*a*, 4*b* has a respective connecting opening 6 around the principal axis 2. The connecting openings 6 each have the same cross-section and are disposed centrally relative to one another and to the principal axis 2. A bracing element or tie 7 is guided through the connecting openings 6 along a connecting axis 5. In the illustrated exemplary embodiment, the connecting axis 5 coincides with the principal axis 2. It is also possible, in principle, to provide a plurality, in particular more than three, bracing elements 7, which are guided through corresponding connecting openings 6. The tie 7 engages on outermost shaft segments in a non-illustrated manner in such a way that the shaft elements 4*a*, 4*b*, 4*c*, 4*d* are braced against one another axially. For this purpose, the tie 7 preferably has a non-illustrated thread in which a likewise non-illustrated tightening nut engages.

In order to avoid a movement of adjacent shaft segments 4*a*, 4*b* in the circumferential direction relative to one another, they can be connected to one another in a manner which is secure against rotation through the use of a radial tooth coupling, especially a crown toothing (serration). The connecting openings 6 each have a cross-section which is larger than the cross-section of the tie 7, leaving an axial gap 8, especially an annular gap, between each shaft segment 4*a* and the tie 7. The shaft segments 4*a*, 4*b*, etc. form an outer surface 3 of the turbine shaft 1. In the vicinity of the outer surface 3, adjoining shaft segments 4*a*, 4*d* and 4*a*, 4*b* are joined together in such a way as to be impermeable to a fluid due to respective sealing welds 16. Two pairs of adjoining shaft segments 4*d*, 4*e* and 4*b*, 4*c* are preferably disposed against one another in such a way that respective first and second radial passages (or gaps) 9*a*, 9*b* remain between them.

The casing 18 surrounding the turbine shaft 1 has an inflow region 19 for live steam 12. The turbine shaft 1 has a central region 11 which is associated with the inflow region 19 and has a cavity 13 therein. This cavity 13 and the central region 11 of the turbine shaft 1 are shielded from direct contact with hot working fluid, that is the live steam 12, flowing through the inflow region 19, by a shielding element 17. The shielding element 17 has a rotationally symmetrical structure with respect to the principal axis 2 and has a raised portion which points away from the principal axis 2. The shielding element 17 serves to divide the working fluid 12, that is the live steam, into two approximately equal partial streams. The shielding element 17 is connected to the casing 18 by a first fixed-blade row 14 of each partial stream. Cooling fluid passes through the casing 18, the first fixed-blade row 14 and the shielding element 17 into the cavity 13 through non-illustrated cooling fluid feeds. The cooling fluid cools the turbine shaft 1 in the cavity in the central region 11. The cooling fluid in the cavity 13 can be heated by the working fluid 12 by virtue of heat exchange and can be fed back to the steam process through non-illustrated fluid discharge conduits.

As is customary with a steam turbine, rotating-blade rows 15 connected to the turbine shaft 1 and fixed-blade rows 14 connected to the casing 18 are disposed alternately one behind the other axially, in the direction of flow of the working fluid 12. Cooling of the turbine shaft 1 from the inside out as well, particularly in the central region 11, is achieved by the inflow of working fluid 12, which is already somewhat expanded, into the axial gap 8 between the tie 7 and the shaft segments 4*d*, 4*a*, 4*b* through the first radial passage 9*a*. This partial stream of the working fluid 12 acts as a cooling fluid 12*b*, which is first of all guided counter to the direction of flow of the partial stream flowing towards the left in the illustration. The cooling fluid 12*b* enters the rightward partial stream through the second radial passage 9*b* at a relatively low-pressure location and thus once more performs work on the rotating blades 15 through which flow is yet to occur. In the illustrated turbine 1, the cooling fluid 12*b* can be taken from the leftward partial stream through the first radial passage 9*a*, at a pressure of about 11 bar and a temperature of about 400° C., and returned to the rightward partial stream at a pressure level of less than 11 bar. It is likewise possible, for the purpose of cooling, to connect the axial gap 8 to the cavity 13 in terms of flow. The axial gap 8 is preferably supplied with a volume flow amounting to 1% to 4%, in particular 1.5% to 3% of the total volume flow of live steam driving the turbine shaft.

The invention is distinguished by a turbine shaft which has a plurality of shaft segments that are disposed axially one behind the other, are braced together and are provided in their interior with an axial gap. This gap is connected in terms of flow to the stream of the working fluid driving the turbine shaft through two radial passages at two different pressure levels. The radial passages are preferably located where two shaft segments adjoin one another in each case. The different pressure levels at which the respective radial passages emerge at the outer surface of the turbine shaft are sufficient in themselves to ensure that a flow of cooling fluid is diverted from the working fluid (live steam), and the flow is driven by the pressure difference. A stream of cooling steam diverted from the stream of live steam passes through the first radial passage into the axial gap and, from there, through the second radial passage back into the stream of live steam. That region of the turbine shaft which is adjacent the axial gap is thereby cooled from the inside, and the cooling fluid used for cooling is fed back to the overall steam process.

We claim:

1. A turbine shaft of a steam turbine, comprising:

an outer surface;

a plurality of cylindrical shaft segments disposed axially one behind the other along a principal axis;

said shaft segments each having a connecting opening along a common connecting axis for receiving a bracing element guided through said connecting openings and defining an axial gap between the bracing element and at least one of said shaft segments; and two axially spaced-apart radial passages connected to said axial gap in term of flow and each opening at said outer surface therein allowing the flow of a working medium to act as a cooling medium.

2. The turbine shaft according to claim 1, wherein the bracing element is a central tie for which said principal axis and said connecting axis coincide.

3. The turbine shaft according to claim 1, wherein said connecting openings receive at least three bracing elements with respective connecting axes aligned parallel to said principal axis.

4. The turbine shaft according to claim 1, wherein at least one of said radial passages is disposed between an adjoining two of said shaft segments.

5. The turbine shaft according to claim 1, including an axial central region for inflow and flow division of a working fluid, said central region disposed axially between said radial passages.

6. The turbine shaft according to claim 5, wherein said central region has a cavity formed therein through which cooling fluid can flow.

7. The turbine shaft according to claim 6, wherein said cavity is connected to said axial gap in terms of flow.

8. A steam turbine, comprising:

a turbine shaft extended along a principal axis and having an outer surface and a plurality of cylindrical shaft segments disposed axially one behind the other along said principal axis, said shaft segments each having a connecting opening formed therein along a common connecting axis;

a bracing element guided through said connecting openings and defining an axial gap between said bracing element and at least one of said shaft segments; and two axially spaced-apart radial passages connected to said axial gap in term of flow and each opening at said outer surface therein allowing the flow of a working medium to act as a cooling medium.

9. A double-flow steam turbine, in particular of a double-flow medium-pressure turbine-section, comprising:

a turbine shaft extended along a principal axis and having an outer surface and a plurality of cylindrical shaft segments disposed axially one behind the other along said principal axis, said shaft segments each having a connecting opening formed therein along a common connecting axis;

a bracing element guided through said connecting openings and defining an axial gap between said bracing element and at least one of said shaft segments; and two axially spaced-apart radial passages connected to said axial gap in term of flow and each opening at said outer surface therein allowing the flow of a working medium to act as a cooling medium.

10. In a method for cooling a turbine shaft of a steam turbine having a plurality of cylindrical shaft segments disposed axially one behind the other along a principal axis and braced together by a bracing element, the improvement which comprises:

introducing cooling steam into an axial gap between the bracing element and the shaft segment through a first radial passage and guiding the cooling steam out of the turbine shaft through a second radial passage.

11. The method according to claim 10, which comprises supplying the axial gap with a volume flow of steam equal to 1.0% to 4.0% of a total volume flow of live steam.

12. The method according to claim 10, which comprises supplying the axial gap with a volume flow of steam equal to 1.5% to 3% of a total volume flow of live steam.

* * * * *